US011143022B2

(12) United States Patent
Gao et al.

(10) Patent No.: US 11,143,022 B2
(45) Date of Patent: Oct. 12, 2021

(54) TELEMETRY SYSTEM

(71) Applicant: Halliburton Energy Services, Inc., Houston, TX (US)

(72) Inventors: Li Gao, Katy, TX (US); Ramachandhran Balasubramanian, San Jose, CA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/315,525

(22) PCT Filed: Aug. 14, 2016

(86) PCT No.: PCT/US2016/046950

§ 371 (c)(1),
(2) Date: Jan. 4, 2019

(87) PCT Pub. No.: WO2018/034637

PCT Pub. Date: Feb. 22, 2018

(65) Prior Publication Data

US 2019/0301279 A1 Oct. 3, 2019

(51) Int. Cl.

| | |
|---|---|
| ***E21B 47/16*** | (2006.01) |
| ***E21B 47/18*** | (2012.01) |
| ***E21B 41/00*** | (2006.01) |
| ***E21B 47/12*** | (2012.01) |

(52) U.S. Cl.

CPC ..... *E21B 47/16* (2013.01); *E21B 41/00* (2013.01); *E21B 47/12* (2013.01); *E21B 47/18* (2013.01)

(58) Field of Classification Search

CPC ..... E21B 47/12; E21B 47/16; E21B 47/18; E21B 41/00

USPC ..... 340/81

See application file for complete search history.

(56) References Cited

U.S. PATENT DOCUMENTS

| | | | |
|---|---|---|---|
| 3,811,519 | A | 5/1974 | Driver |
| 4,035,023 | A | 7/1977 | Cockrell |
| 4,828,050 | A | 5/1989 | Hashimito |
| 5,753,812 | A | 5/1998 | Aron et al. |
| 6,352,110 | B1 | 3/2002 | Langseth et al. |

(Continued)

FOREIGN PATENT DOCUMENTS

| | | |
|---|---|---|
| AU | 2012381021 | 10/2015 |
| GB | 2445208 | 7/2008 |

(Continued)

OTHER PUBLICATIONS

International Search Report and Written Opinion of PCT Application No. PCT/US2016/046950 dated Mar. 20, 2017: pp. 1-14.

(Continued)

*Primary Examiner* — Omar Casillashernandez

(74) *Attorney, Agent, or Firm* — Chamberlain Hrdlicka

(57) ABSTRACT

A system and method for signal communication using a piezoelectric fiber composite (PFC) sensor. A telemetry module is locatable within a borehole intersecting a subterranean earth formation. The PFC sensor is coupled to a carrier in communication with the telemetry module. The PFC sensor is configured to generate a signal indicative of a stress in the carrier. A processor in communication with the PFC sensor is configured to convert the signal generated by the PFC sensor into a telemetry signal transmitted by the telemetry module.

19 Claims, 5 Drawing Sheets

(56) References Cited

U.S. PATENT DOCUMENTS

| | | | | |
|---|---|---|---|---|
| 6,629,341 | B2 | 10/2003 | Wilkie et al. | |
| 6,644,848 | B1 | 11/2003 | Clayton et al. | |
| 6,736,905 | B2 | 5/2004 | Smith et al. | |
| 6,826,343 | B2 | 11/2004 | Davis et al. | |
| 7,068,183 | B2 | 6/2006 | Shah et al. | |
| 8,689,884 | B2 | 4/2014 | Young et al. | |
| 8,770,276 | B1 | 7/2014 | Nish et al. | |
| 9,267,338 | B1 | 2/2016 | LeBlanc et al. | |
| 9,341,505 | B2 * | 5/2016 | Foster | G01F 1/34 |
| 9,541,666 | B2 * | 1/2017 | Frey | G01V 3/38 |
| 9,822,636 | B2 | 11/2017 | Chu | |
| 2004/0200613 | A1 * | 10/2004 | Fripp | E21B 47/0006 166/250.01 |
| 2006/0219438 | A1 | 10/2006 | Moore et al. | |
| 2008/0073086 | A1 | 3/2008 | Cook et al. | |
| 2009/0173493 | A1 | 7/2009 | Hutin et al. | |
| 2011/0185815 | A1 | 8/2011 | McCann | |
| 2012/0032560 | A1 * | 2/2012 | Ochoa | E21B 47/18 310/339 |
| 2012/0080227 | A1 | 4/2012 | Carolinian et al. | |
| 2012/0103688 | A1 | 5/2012 | Coman et al. | |
| 2013/0008671 | A1 | 1/2013 | Booth | |
| 2013/0154845 | A1 * | 6/2013 | Brooks | E21B 47/18 340/854.3 |
| 2015/0137817 | A1 * | 5/2015 | Wilson | E21B 43/10 324/333 |
| 2015/0300122 | A1 | 10/2015 | George et al. | |
| 2016/0115776 | A1 * | 4/2016 | Haci | E21B 29/00 175/27 |
| 2016/0290073 | A1 * | 10/2016 | Zheng | E21B 47/00 |
| 2016/0333679 | A1 * | 11/2016 | Getzlaf | E21B 34/10 |
| 2017/0075016 | A1 * | 3/2017 | Cotton | G01V 1/52 |
| 2017/0306719 | A1 | 10/2017 | Jerez | |

FOREIGN PATENT DOCUMENTS

| | | |
|---|---|---|
| WO | 2001090532 | 11/2001 |
| WO | 2014179452 | 11/2014 |
| WO | 2016036926 | 3/2016 |

OTHER PUBLICATIONS

Nagata et al., "Structural Sensing and Actuation Utilizing Macro Fiber Composite," Proceedings of the 2006 IEEE International Conference on Robotics and Biomimetics, Dec. 2006: 1275-1280.

Sodano, "Macro-Fiber Composites for Sensing, Actuation and Power Generation," Virginia Polytechnic Institute, Jul. 2003: 1-151.

Wait et al., "Validation of Macro Fiber Composites as Strain Sensors," Proceedings of 2007 IMAC-XXV, 2007: 1-12, <https://www.google.com/url?sa=t&rct=j&q=&esrc=s&source=web&cd=1&cad=rja&uact=8&ved=2ahUKEwjhxMnCq5vfAhUBOKwKHcMEC2EQFjAAegQIBRAC&url=http%3A%2F%2Fsemimac.org%2Fwp-content%2Fuploads%2F2016%2F01%2Fsem.org-IMAC-XXV-s04p03-Validation-Macro-Fiber-Composites-as-Strain-Sensors.pdf&usg=AOvVaw2ohj5naPINmwLnyTRoHsxd>.

Wilkie et al., "Recent Developments in NASA Piezocomposite Actuator Technology," NASA Technical Reports Server, Apr. 2004: pp. 1-4.

* cited by examiner

TELEMETRY SYSTEM

BACKGROUND

This section is intended to provide background information to facilitate a better understanding of the various aspects of the described embodiments. Accordingly, it should be understood that these statements are to be read in this light and not as admissions of prior art.

Subterranean drilling systems may use telemetry systems to transmit telemetry data from subterranean tools to information handling systems positioned at the surface. These telemetry systems may include mud pulse telemetry systems that generate pressure pulses in a flow of drilling fluid through the drill string. The pressure pulses may be detected at the surface. One example pulse detection mechanism employs one or more pressure sensors placed in physical access to the drilling fluid flow stream at the surface (e.g., transducers or taps). Another example pulse detection mechanism uses a fiber optic loop wrapped around the outside of the drilling fluid flow pipe. The fiber optic pulse detector may provide information about disturbances or vibrations within the fiber optic loop by generating a light signal with a predetermined wavelength, transmitting the light signal through an optical fiber loop, and detecting the resulting coherent light phase shift.

The telemetry system can also use the drill string as the transmission channel of the telemetry signal. For these systems, acoustic sensors placed on the drill string (e.g., acoustic transducers or piezoelectric transducers) can be used to detect the acoustic signals transmitted along the drill string.

BRIEF DESCRIPTION OF THE DRAWINGS

For a detailed description of the embodiments of the invention, reference will now be made to the accompanying drawings in which.

DETAILED DESCRIPTION

This disclosure provides a system and method for telemetry signal communication. Specifically, this disclosure provides a telemetry system that uses a piezoelectric fiber composite (PFC) sensor acoustically coupled to a carrier in communication with a telemetry module to detect a transmitted telemetry signal.

Some mud pulse telemetry sensors use pressure pulse transducers within the flow pipe to detect the telemetry signals. Other mud pulse telemetry sensors use complex fiber optic telemetry signal detection methods that pose compensation challenges. A PFC sensor offers a flexible piezoelectric material that can be easily attached to a surface pipe to detect a stress in the pipe generated by telemetry pulses travelling through either the pipe or fluid within the pipe (e.g., drilling fluid). The PFC sensor can include an active fiber composite (AFC) sensor, a macro-fiber composite (MFC) sensor, a structural material with integrated piezoelectric fibers, or any other suitable arrangement of piezoelectric fibers. The AFC sensor includes a sheet of unidirectionally aligned cylindrical piezoelectric fibers coupled in an epoxy matrix; while the MFC sensor includes a sheet of unidirectionally aligned rectangular piezoelectric fibers (e.g., piezoceramic fibers formed as rectangular prisms) coupled in an epoxy matrix. The sheet of fibers in the AFC or MFC sensor can be coupled between layers of adhesive and electrodes. The epoxy sheet of piezoelectric fibers allows the PFC sensor to flex or curve, such as curving in an arc, ring, or helix. In addition, employing spatial diversity of PFC sensors coupled to the surface pipe may yield a gain in signal-to-noise ratio (SNR). Spatial diversity uses multiples PFC sensors that are physically separated from one another to generate and compare multiple signals indicative of the stress induced by the telemetry signal. A gain in SNR can greatly enhance telemetry signal detectability, channel capacity, and data throughput.

Figure 1:
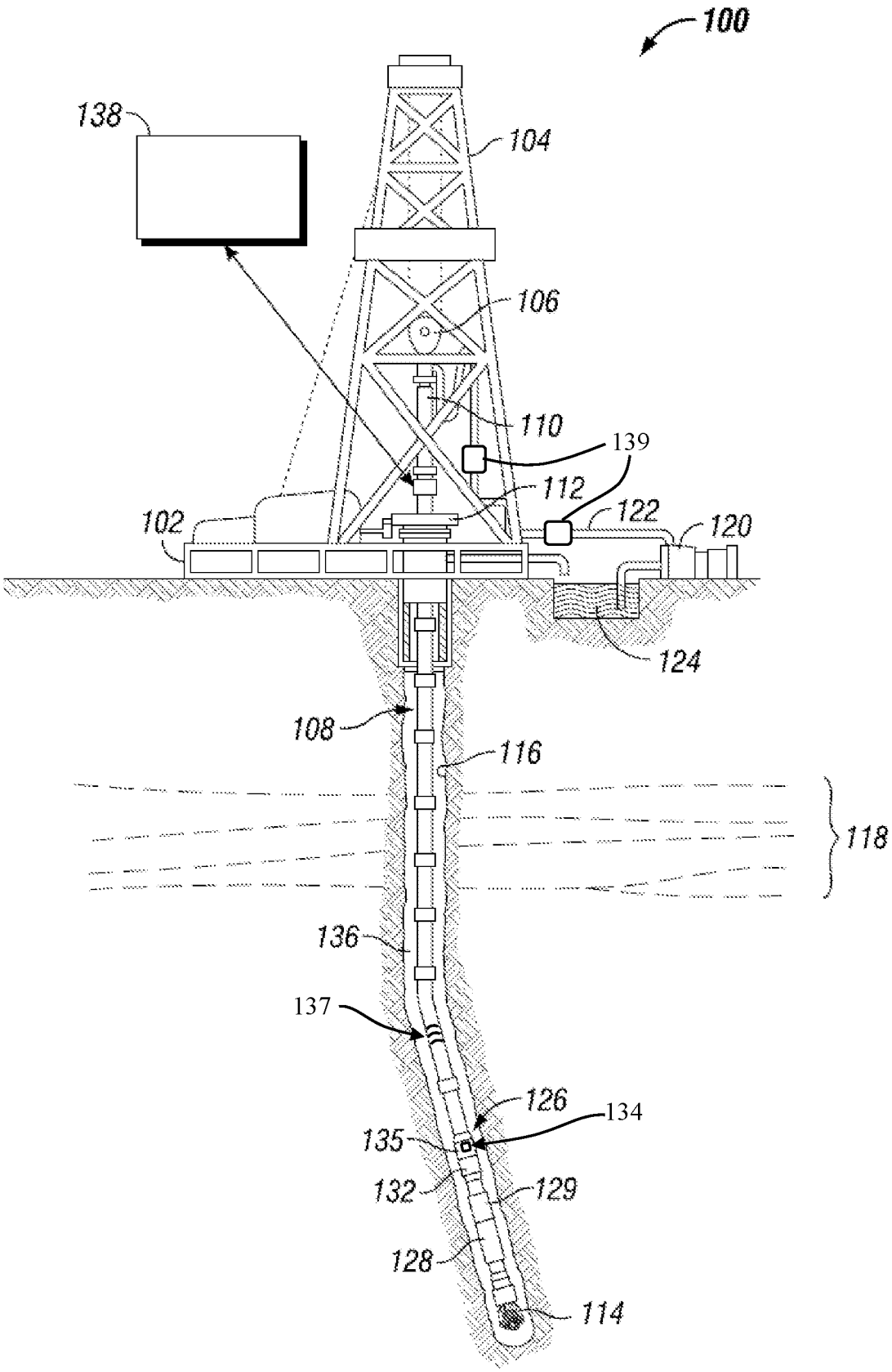
FIG. 1 depicts a schematic view of a drilling operation, according to one or more embodiments.

FIG. 1 depicts a schematic view of a drilling operation utilizing a directional drilling system 100 in accordance with one or more embodiments. The system 100 is used to direct a drill bit in drilling a borehole, such as a subsea well or a land well. Further, it will be understood that the present disclosure is not limited to only drilling an oil well. The present disclosure also encompasses natural gas boreholes, other hydrocarbon boreholes, or boreholes in general. Further, the present disclosure may be used for the exploration and formation of geothermal boreholes intended to provide a source of heat energy instead of hydrocarbons.

As shown in FIG. 1, a tool string 126 is located in a directional borehole 116 and includes a rotary steerable tool 128. The rotary steerable tool 128 provides full 3D directional control of the drill bit 114. A drilling platform 102 supports a derrick 104 having a traveling block 106 for raising and lowering a drill string 108. A kelly 110 supports the drill string 108 as the drill string 108 is lowered through a rotary table 112. Alternatively a top drive is used to rotate the drill string 108 in place of the kelly 110 and the rotary table 112. A drill bit 114 is positioned at the distal end of the tool string 126, and may be driven by a downhole motor 129 positioned on the tool string 126 and/or by rotation of the entire drill string 108 from the surface. As the bit 114 rotates, the bit 114 creates the borehole 116 that passes through various formations 118. A pump 120 circulates drilling fluid through a feed pipe 122 and downhole through the interior of drill string 108, through orifices in drill bit 114, back to the surface via the annulus 136 around drill string 108, and into a retention pit 124. The drilling fluid transports cuttings from the borehole 116 into the pit 124 and aids in maintaining the integrity of the borehole 116. The drilling fluid may also drive the downhole motor 129.

The tool string 126 may include one or more logging while drilling (LWD) or measurement-while-drilling (MWD) tools 132 that collect measurements relating to various borehole and formation properties as well as the position of the bit 114 and various other drilling conditions as the bit 114 extends the borehole 108 through the formations 118. The LWD/MWD tool 132 may include a device for measuring formation resistivity, a gamma ray device for measuring formation gamma ray intensity, devices for measuring the inclination and azimuth of the tool string 126, pressure sensors for measuring drilling fluid pressure, temperature sensors for measuring borehole temperature, etc.

The tool string 126 may also include a telemetry module 134. The telemetry module 134 receives data provided by the various sensors of the tool string 126 (e.g., sensors of the LWD/MWD tool 132), and transmits the data as telemetry signals 137 to a surface control unit 138. Data may also be provided by the surface unit 138, received by the telemetry module 134, and transmitted to the tools (e.g., LWD/MWD tool 132, rotary steering tool 128, etc.) of the tool string 126. As an example, the telemetry signals 137 are transmitted as pressure pulses through the drilling fluid or as acoustic pulses through the drill string 108. Telemetry sensors 139 may be coupled to the feed pipe 122 and/or the kelly 110 (not shown) to detect telemetry signals transmitted by the telemetry module 134. Telemetry sensors 139 can include PFC sensors configured to generate a signal indicative of a stress in the feed pipe 122 or the kelly 110 induced by telemetry signals traveling through the tubular or fluid within the tubular. In one or more embodiments, mud pulse telemetry, wired drill pipe, acoustic telemetry, or other telemetry technologies known in the art may be used to provide communication between the surface control unit 138 and the telemetry module 134. In one or more embodiments, the surface unit 138 may communicate directly with the LWD/MWD tool 132 and/or the rotary steering tool 128. The surface unit 138 may be a computer stationed at the well site, a portable electronic device, a remote computer, or distributed between multiple locations and devices. The unit 138 may also be a control unit that controls functions of the equipment of the tool string 126.

Figure 2A:
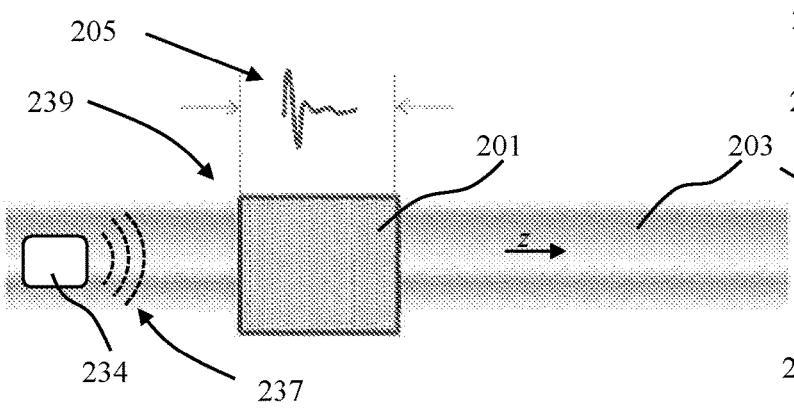
FIGS. 2A and 2B depict schematics of a telemetry sensor coupled to a carrier, according to one or more embodiments.
Figure 2B:
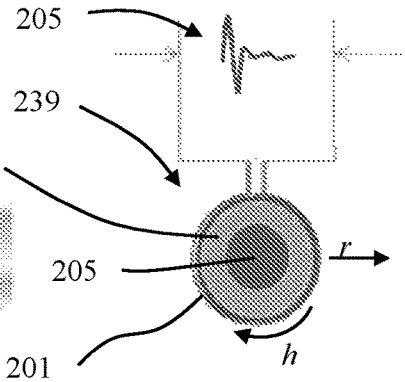

FIGS. 2A and 2B depict schematic views of a telemetry sensor 239, in accordance with one or more embodiments. The telemetry sensor 239 includes one or more PFC sensors 201 coupled to a carrier 203. The PFC sensor 201 can include an AFC sensor, an MFC sensor, a structural material with integrated piezoelectric fibers, or any other suitable arrangement of piezoelectric fibers. FIG. 2A shows a portion of the carrier 203 along its longitudinal axis, while FIG. 2B shows a cross-section of the PFC sensor 201 arranged around the carrier 203 looking down the bore 205 of the carrier 203.

In one or more embodiments, the carrier 203 can include feed pipe, kelly, drill string, drill pipe, coiled tubing, casing, liners, production tubing, hydraulic control lines, pipe, tubing, or combinations thereof. Carrier 203 can include any suitable acoustic transmission device that can experience a stress (e.g., cylindrical stress components including hoop stress, axial stress, or radial stress) produced by a telemetry pulse or acoustic pulse transmitted through the carrier 203 or fluid within the carrier 203. Further, the telemetry sensor 239 can be positioned anywhere along the carrier 203 downhole or at the surface to detect telemetry signals 237. The telemetry sensor 239 can generate a signal 205 indicative of a stress in the carrier 203 produced by the telemetry signal 237.

The PFC sensors 201 can be coupled to the carrier 203 so as to surround at least a portion of the carrier 203. In one or more embodiments, multiple PFC sensors 201 can be arranged on the carrier 203 by forming a ring around the carrier 203 as depicted in FIG. 2B. The PFC sensor 203 may also be arranged to form an arc along the carrier 203 or a helix (not shown) along the carrier 203. The helix arrangement of the PFC sensors 201 can allow the telemetry sensor 239 to detect a stress produced in the axial direction (axial stress, z) of the carrier 203. Alternatively, the arc or ring arrangement of the PFC sensors 201 allows the telemetry sensor 239 to detect a stress applied in the radial direction (radial stress, r) or in the azimuthal direction (hoop stress, h) of the carrier 203. The hoop stress is exerted circumferentially around the carrier 203 and perpendicular to both the axial stress (z) and the radial stress (r).

When a telemetry signal 237 travels past the PFC sensor 201, the signal 237 induces a change in the stresses in the carrier 203. For example, the telemetry signal 237 can induce an expansion or contraction of the carrier's shape to cause cylindrical stresses. In one or more embodiments, the cylindrical stress induces a voltage in the PFC sensor 201 and generates signal 205 indicative of the stress in the carrier 203. The telemetry signal 237 can be transmitted through either the carrier 203 or a fluid (e.g., drilling fluid) within the carrier 203 using a telemetry module 234 that includes a transmitter (e.g., a transducer) located downhole or at the surface.

Figure 3:
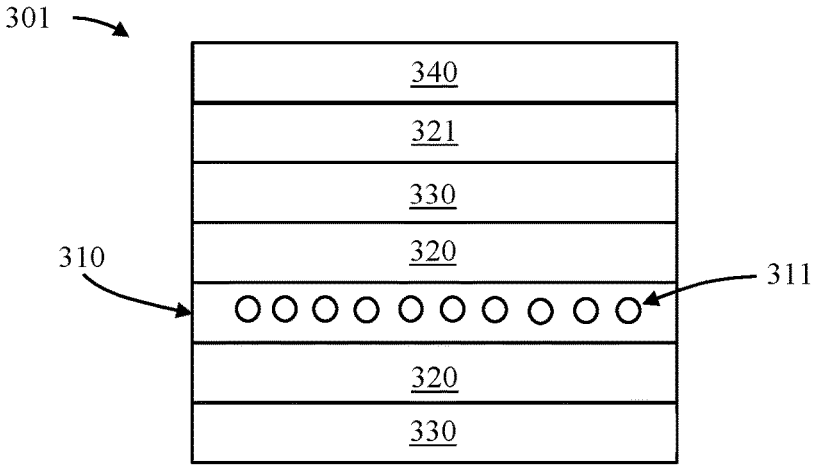
FIG. 3 depicts a cross-section of a piezoelectric fiber composite (PFC) sensor, according to one or more embodiments.

FIG. 3 depicts a cross-section of the PFC sensor 301 showing its layers, according to one or more embodiments. A sheet 310 of piezoelectric fibers 311 can be layered between an adhesive 320, which couples the sheet 310 to opposing electrodes 330. The sheet 310 of piezoelectric fibers 311 allows the PFC sensor 301 to flex or curve, such as flexing in an arc, ring, or helix. This allows the PFC sensor 301 to be mounted to a curved surface, such as a tubular. As illustrated, the piezoelectric fibers 311 are unidirectionally aligned and parallel with the longitudinal axis of the PFC sensor 301. In one or more embodiments, the PFC sensor 301 can include one or more sheets 310 layered between the electrodes 330.

Optionally, the PFC sensor 301 can include a structural material 340 integrated with the piezoelectric fibers 311, in accordance with one or more embodiments. The structural material 340 can be coupled to one of the electrodes 330 via an additional layer of adhesive 321. In particular, the structural material 340 can be selected to adjust the integrity, sensitivity, or structural conformity of the PFC sensor 301. In one or more embodiments, the structural material 340 can shape the PFC sensor 301 to conform to the shape of the carrier 203 of FIG. 2. In particular, the structural material 340 can shape the PFC sensor 301 to form a rigid arcuate segment that conforms to the outer diameter of the carrier 203 of FIG. 2. The structural material 340 can include at least one of a metallic material, a plastic, a glass, a ceramic, a glass-fiber reinforced plastic (fiberglass), a carbon fiber-reinforced polymer (carbon fiber), a carbon nano-tube reinforced polymer, any suitable fiber-reinforced composite material, any suitable ductile or rigid material, and combinations thereof.

Figure 4:
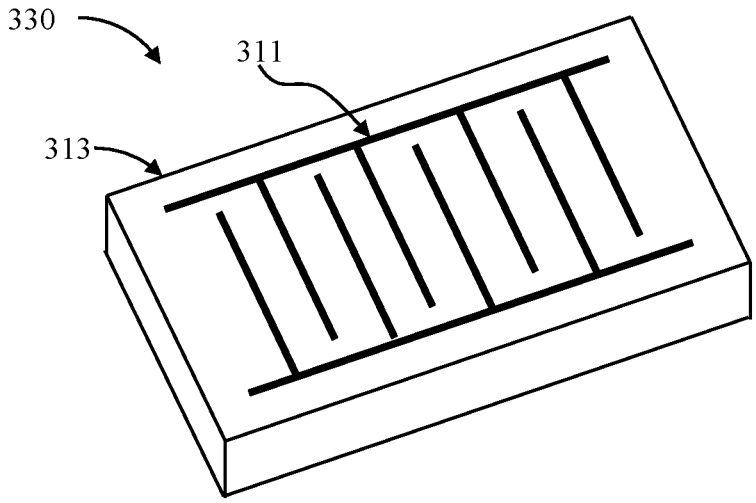
FIG. 4 depicts an isometric view of an electrode layer, according to one or more embodiments.

FIG. 4 shows an isometric view of the electrode layer 330, in accordance with one or more embodiments. The electrode layer 330 can include interdigitated electrodes 311 (such as copper electrodes) located on a film 313 (such as a polyimide film).

Figure 5A:
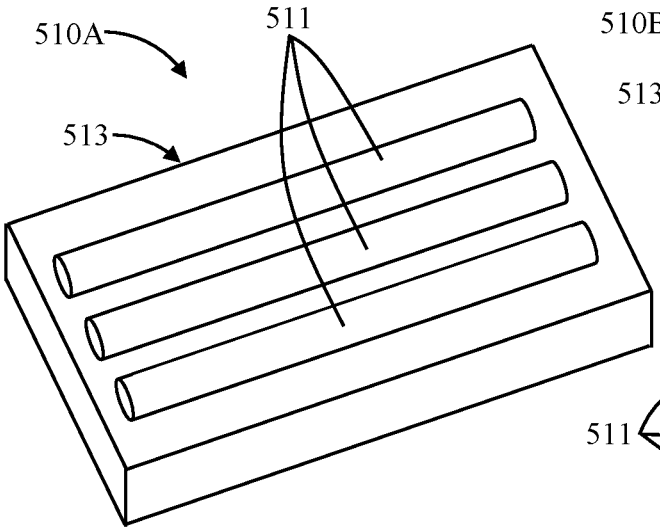
FIGS. 5A and 5B depict isometric views of sheets of piezoelectric fibers, according to one or more embodiments.
Figure 5B:
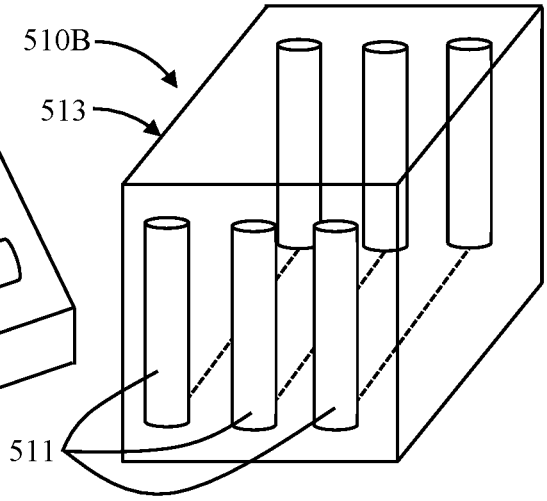

FIGS. 5A and 5B depict isometric views of the sheets 510A, 510B of piezoelectric fibers 411, in accordance with one or more embodiments. The sheets 510A, 510B of piezoelectric fibers 411 can be used, as described above, with respect to the PFC sensors 201, 301 of FIGS. 2 and 3, respectively. In particular, the piezoelectric fibers 511 may include piezoceramic fibers or any other suitable piezoelectric material that can be made into a flexible fiber. The piezoelectric fibers 511 can be coupled together in an adhesive 513, such as an epoxy matrix. The piezoelectric fibers 511 can vary in size, and as a non-limiting example, a piezoelectric fiber 511 can have a diameter, thickness, or width between about 10 to about 250 μm. Optionally, a piezoelectric fiber 511 can have a diameter, width, or thickness that is less than about 250 μm. In one or more embodiments, a piezoelectric fiber 511 can have a diameter, width or thickness that is greater than about 250 μm. The piezoelectric fibers 511 can vary in shape, forming cylinders (AFC), rectangular prisms (MFC), triangular prisms, hexagonal prisms, any other suitable shape for a fiber of a piezoelectric material, or combinations thereof. The sheets 510A, 510B can include unidirectionally aligned (i.e., parallel) piezoelectric fibers 511. In FIG. 5A, the fibers 511 are aligned parallel with the longitudinal axis of sheet 510A. In FIG. 5B, the fibers 511 are aligned perpendicular to the longitudinal axis of sheet 510B. In one or more embodiments, the sheets 510A, 510B can have any number of piezoelectric fibers 511 in any sort of arrangement or alignment to provide a PFC sensor, such as the sensor 201, suitable to detect a stress in the carrier 203 of FIG. 2.

Figure 6:
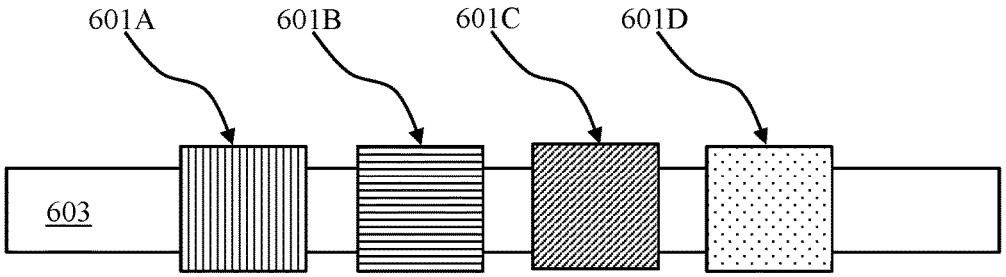
FIG. 6 depicts various arrangements of PFC sensors on the carrier, according to one or more embodiments.

FIG. 6 shows various arrangements of the PFC sensors 601A-601D positioned on the carrier 603, in accordance with one or more embodiments. Each of the sensors 601A-601D can couple around at least a portion of the circumference of the carrier 603. As illustrated, the PFC sensor 601A is positioned on the carrier 603 so that its sheet of piezoelectric fibers (such as the sheet 510A of FIG. 5A) is orthogonal to the longitudinal axis of the carrier 603. The PFC sensor 601B is positioned on the carrier 603 so that its sheet of piezoelectric fibers (such as the sheet 510A) is aligned with the longitudinal axis of the carrier 603. The PFC sensor 601C is positioned on the carrier 603 so that its sheet of piezoelectric fibers (such as the sheet 510A) is angled with respect to the longitudinal axis of the carrier 603 (e.g., angled at 45° from the longitudinal axis). The PFC sensor 601D is positioned on the carrier so that its sheet of piezoelectric fibers (such as the sheet 510B of FIG. 5B) is aligned with the radial axis of the carrier 603. In one or more embodiments, the PFC sensors 601A-601D can have their sheets of piezoelectric fiber angled with respect to the longitudinal axis or radial axis of the carrier 603 in any sort of orientation suitable to detect a stress in the carrier 603.

The orientation of the PFC sensors 601A-601D may be selected to detect a cylindrical stress component. For example, the orientation of the PFC sensor 601D may be more sensitive to the radial stress (r) than the axial stress (z) or the hoop stress (h), while the orientation of the PFC sensor 610A may be more sensitive to the axial stress (z) than the radial stress (r). It will be appreciated that the signals generated by the PFC sensors 601A-601D can be decomposed into the cylindrical stress components (z, r, or h).

Referring to FIG. 6, the PFC sensors 601A-601D are axially spaced from each other on the carrier 603. In one or more embodiments, two or more of the PFC sensors 601A-601D may be co-located on the carrier 603. Optionally, two or more of the sheets of the piezoelectric fibers of the PFC sensors 601A-601D may be integrated into a single PFC sensor.

Referring to FIGS. 2A and 2B, applying the model parameters in Tables 1 and 2 (below), a model of the voltage ($V_c$) induced by the PFC sensor 201 due to a hoop stress ($\varepsilon_h$) is given by Equation (1) as an example:

$$V_c = \frac{d_{31} \cdot Y_{mfc} \cdot l_c \cdot b_c \cdot \varepsilon_h}{C_p} \tag{1}$$

The hoop stress ($\varepsilon_h$) is given by Equation (2):

$$\varepsilon_h = A \cdot b + \frac{B}{b^2}, \tag{2}$$

$$A = \frac{1-\nu}{Y} \cdot \frac{a^2 p - b^2 p_o}{b^2 - a^2}, \tag{3}$$

$$B = \frac{(1+\nu)(p-p_o)}{Y} \cdot \frac{a^2 b^2}{b^2 - a^2} \tag{4}$$

where $p_o$ represents the pressure outside the carrier, e.g., atmospheric pressure. Equations 1-4 relate the voltage induced by the PFC sensor 201 to the hoop stress ($\varepsilon_h$) produced by a telemetry signal. Other models can be used to relate the voltage induced by the PFC sensor 201 to the cylindrical stress components in the carrier 203 produced by the telemetry signal 237. According to the model parameters in Tables 1 and 2, a theoretical voltage generated by the PFC sensor 201 is calculated to be about 22.7 mV when a 2 psi mud pulse passes through the carrier 203. This shows that the mud pulse is easily detectable using the PFC sensor 201.

TABLE 1

| Pipe and mud pulse parameters | |
|---|---|
| Pipe outer radius | $a = \frac{3.826}{2} \cdot in$ |
| Pipe inner radius | $b = \frac{5}{2} \cdot in$ |
| Pipe static pressure | $p = 5000 \cdot psi$ |
| Pipe Young's modulus | $Y = 200 \cdot 10^9 \cdot Pa$ |
| Poisson's ratop | $v = 0.29$ |
| Mud pulse signal amplitude at surface | $\Delta p = 2 \cdot psi$ |

TABLE 2

| PFC sensor material parameters | |
|---|---|
| PZT material type | Navy Type II |
| Young's modulus | $Y_{mfc} = 30 \cdot 34 \cdot 10^9 \cdot Pa$ |
| Piezoelectric coefficient | $d_{31} = -3.7 \cdot 10^{-10} \frac{C}{N}$ |
| Capacitance | $C_p = 26\ nF$ |
| Active area dimensions ($l_c \cdot b_c$) | $s_c = 0.028 \cdot 0.014 \cdot m^2$ |

The PFC sensor 201 can be coupled to the carrier 203 in various ways, such as tightly fixing the PFC sensor 201 to the carrier 203, indirectly coupling the PFC sensor 201 to the carrier 203, or coupling a portion of PFC sensor 201 to the carrier 203. As an example, the PFC sensor 201 can be adhesively coupled to the carrier 203 using glue, epoxy, or any other suitable adhesive. Alternatively, the PFC sensor 201 can be removeably coupled to the carrier 203 using mechanical hose clamps, cable zip ties, or any other suitable removable fastener. In particular, these removable fasteners allow the PFC sensor 201 to be easily relocated during drilling operations so as to optimize telemetry signal detection, such as improving SNR. Also, the PFC sensor 201 can be coupled to the carrier 203 anywhere along the transmission path of the telemetry signal. For mud pulse telemetry systems, the PFC sensor 201 can be coupled to the carrier 203 without tapping into the flow path of the drilling fluid.

A transfer function of the transmission path of the telemetry signal 237 can be used to detect the telemetry signal 237 using the PFC sensor 201. The transfer function can be determined using a known input signal transmitted along the transmission path and the detected output signal from the PFC sensor 201. A cross-correlation of the input signal and the detected output signal can be used to optimize the transfer function.

Figure 7:
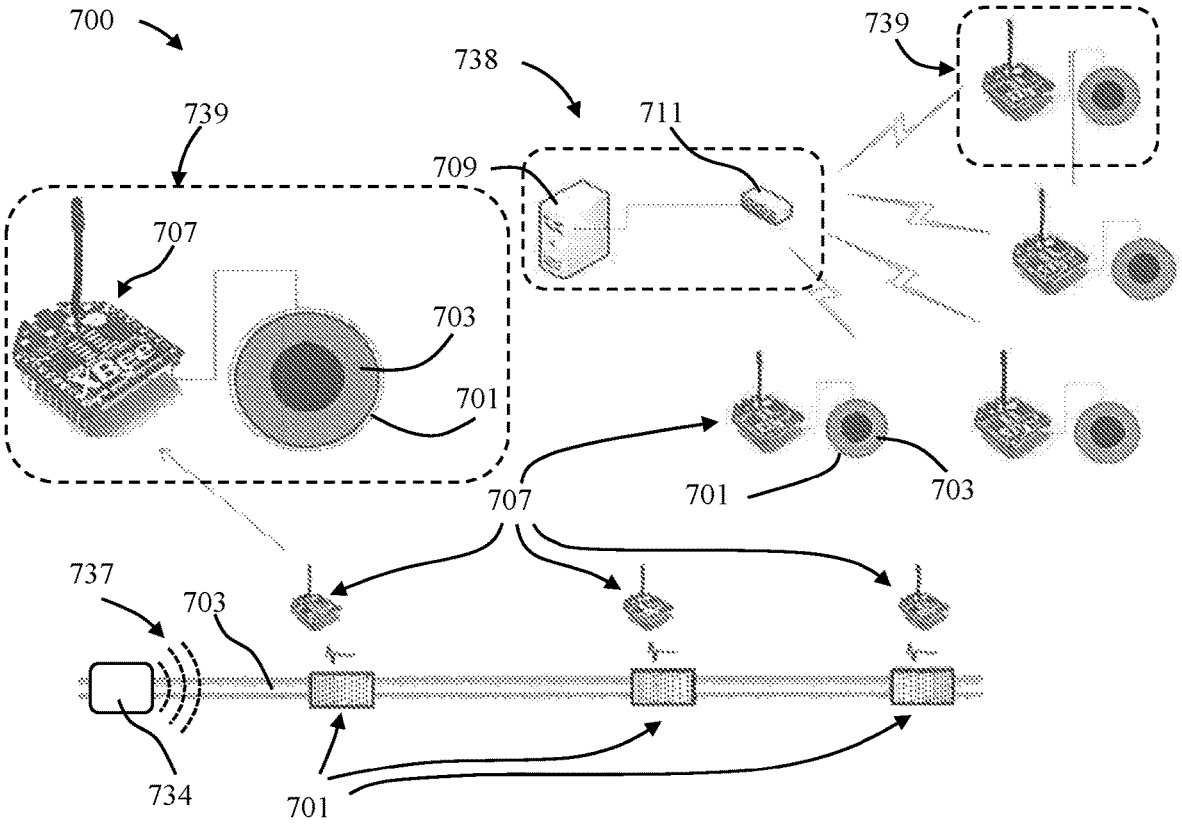
FIG. 7 depicts a schematic of a telemetry system, according to one or more embodiments.

FIG. 7 depicts an example telemetry system 700 in accordance with one or more embodiments. The telemetry sensors 739 can be coupled to the carrier 703 to provide spatial diversity along the transmission path of the telemetry signal or diversity in the sensitivity to cylindrical stress components (such as the arrangement of sensors 601A-601D of FIG. 6). In particular, the telemetry signal 737 can be transmitted by a transmitter (e.g., a transducer) located on the telemetry module 734. Also, the telemetry sensors 739 can include a wireless communications module 707 to communicate wirelessly with the surface control unit 738. The wireless communications module 707 may communicate using any suitable systems, such as ZigBee, Bluetooth, UHF, VHF, Wi-Fi, or any other suitable wireless communications system. The surface control unit 738 includes a data acquisition computer 709 and a wireless communication gateway 711 that are in communication with each other. The wireless communication gateway 711 interfaces wireless communications between the telemetry sensors 739 and the data acquisition computer 709. The data acquisition computer 709 includes a processor configured to convert the signal generated by the PFC sensor 701 into a telemetry signal to recover information transmitted by telemetry module 734.

Figure 8:
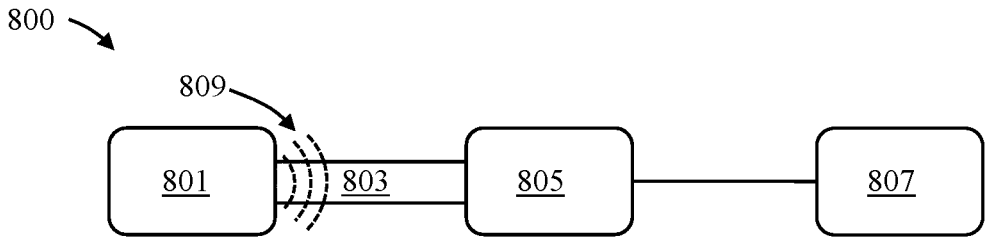
FIG. 8 depicts a schematic of a communications system, according to one or more embodiments.

FIG. 8 depicts a communications system 800, in accordance with one or more embodiments. The communications system 800 can be used, as described above, with respect to the PFC sensors of FIGS. 2-7. The communications system 800 includes a transmitter 801 (e.g., a transducer) in communication with the carrier 803, a PFC sensor 805 coupled to the carrier 803, and a processor 807 in communication with the PFC sensor 805. The transmitter 801 may transmit an acoustic signal 809 through the carrier 803 or a fluid within the carrier 803. The acoustic signal 809 may induce a stress in the carrier 803. The PFC sensor 805 may generate a signal indicative of the stress induced by the acoustic signal 809. The processor 807 may be configured to receive the signal generated by the PFC sensor 805. Further, the processor 807 may be configured to convert the signal generated by the PFC sensor 805 to the acoustic signal 809, recovering information encoded in the acoustic signal 809.

In addition to the embodiments described above, many examples of specific combinations are within the scope of the disclosure, some of which are detailed below:

Example 1

A telemetry system, comprising:
- a telemetry module locatable within a borehole intersecting a subterranean earth formation;
- a carrier in communication with the telemetry module;
- a piezoelectric fiber composite (PFC) sensor coupled to the carrier and configured to generate a signal indicative of a stress in the carrier; and
- a processor configured to receive the signal from the PFC sensor.

Example 2

The telemetry system of example 1, wherein the PFC sensor comprises a sheet of piezoelectric fibers.

Example 3

The telemetry system of example 1, wherein:
- the processor is configured to convert the signal generated by the PFC sensor into a telemetry signal; and
- the processor is in wireless communication with the PFC sensor.

Example 4

The telemetry system of example 1, further comprising an additional PFC sensor coupled to the carrier.

Example 5

The telemetry system of example 1, wherein:
- the telemetry module comprises a transmitter configured to generate a telemetry signal; and
- the telemetry signal is transmitted through at least one of (a) the carrier and (b) a fluid within the carrier.

Example 6

The telemetry system of example 1, wherein:
- the stress is at least one of (a) a hoop stress, (b) an axial stress, and (c) a radial stress; and
- the stress is generated by a telemetry signal traveling through at least one of (a) the carrier and (b) a fluid within the carrier.

Example 7

The telemetry system of example 1, wherein the PFC sensor is coupled to the carrier so as to surround at least a portion of the carrier.

Example 8

The telemetry system of example 7, wherein the PFC sensor is arranged to form at least one of: (a) an arc around the carrier, (b) a ring around the carrier, and (c) a helix around the carrier.

Example 9

A method of telemetry communication in a borehole intersecting a subterranean earth formation, comprising:
- coupling a piezoelectric fiber composite (PFC) sensor to a carrier;
- transmitting a telemetry signal from a location in the borehole to induce a stress in the carrier;
- generating a signal indicative of the stress in the carrier using the PFC sensor; and
- converting the signal generated by the PFC sensor to the telemetry signal.

Example 10

The method of example 9, wherein the PFC sensor comprises a sheet of piezoelectric fibers.

Example 11

The method of example 9, further comprising wirelessly communicating the signal generated by the PFC sensor between the PFC sensor and a processor used to convert the signal to the telemetry signal.

Example 12

The method of example 9, further comprising coupling multiple PFC sensors to the carrier and generating multiple signals indicative of the stress in the carrier from the PFC sensors.

Example 13

The method of example 9, further comprising transmitting the telemetry signal through at least one of (a) the carrier and (b) a fluid within the carrier.

Example 14

The method of example 9, wherein:

the stress is at least one of (a) a hoop stress, (b) an axial stress, and (c) a radial stress; and the stress is produced by the telemetry signal traveling through at least one of (a) the carrier and (b) a fluid within the carrier.

Example 15

The method of example 9, further comprising determining a transfer function for the telemetry signal.

Example 16

The method of example 9, further comprising modeling a voltage generated by the PFC sensor based on the stress.

Example 17

The method of example 9, wherein coupling the PFC sensor to the carrier comprises arranging the PFC sensor around at least a portion of the carrier.

Example 18

The method of example 17, wherein arranging the PFC sensor around the carrier includes arranging the PFC sensor to form at least one of (a) an arc around the carrier, (b) a ring around the carrier, and (c) a helix around the carrier.

Example 19

A communications system, comprising:

a transmitter;

a carrier in communication with the transmitter;

a piezoelectric fiber composite (PFC) sensor configured to generate a signal indicative of a stress in the carrier; and a processor configured to:

receive the signal from the PFC sensor; and convert the signal generated by the PFC sensor to a telemetry signal.

Example 20

The communications system of example 19, wherein the PFC sensor comprises a sheet of piezoelectric fibers.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A telemetry system for use in a borehole intersecting a subterranean earth formation, comprising:

a telemetry module locatable within the borehole and configured to receive data and transmit the data in a telemetry signal;

a carrier in communication with the telemetry module, the telemetry module configured to transmit the telemetry signal through a fluid in the carrier;

a piezoelectric fiber composite (PFC) sensor coupled to the carrier and configured to detect stress in the carrier indicative of the telemetry signal and generate a signal indicative of the detected stress in the carrier; and a processor configured to receive the signal from the PFC sensor.

2. The telemetry system of claim 1, wherein the PFC sensor comprises a sheet of piezoelectric fibers.

3. The telemetry system of claim 1, wherein:

the processor is configured to convert the signal generated by the PFC sensor into the telemetry signal; and the processor is in wireless communication with the PFC sensor.

4. The telemetry system of claim 1, further comprising an additional PFC sensor coupled to the carrier.

5. The telemetry system of claim 1, wherein the telemetry module comprises a transmitter configured to generate the telemetry signal.

6. The telemetry system of claim 1, wherein the stress is at least one of (a) a hoop stress, (b) an axial stress, or (c) a radial stress; and the stress is generated by the telemetry signal.

7. The telemetry system of claim 1, wherein the PFC sensor is coupled to the carrier so as to surround at least a portion of the carrier.

8. The telemetry system of claim 7, wherein the PFC sensor is arranged to form at least one of: (a) an arc around the carrier, (b) a ring around the carrier, or (c) a helix around the carrier.

9. A method of telemetry communication in a borehole intersecting a subterranean earth formation, comprising:

coupling a piezoelectric fiber composite (PFC) sensor to a carrier at the surface;

receiving data in the borehole;

transmitting a telemetry signal from a location in the borehole through a fluid within the carrier to induce a stress in the carrier, the telemetry signal including the received data;

detecting the stress in the carrier and generating a signal indicative of the stress in the carrier using the PFC sensor; and converting the signal generated by the PFC sensor into the telemetry signal.

10. The method of claim 9, wherein the PFC sensor comprises a sheet of piezoelectric fibers.

11. The method of claim 9, further comprising wirelessly communicating the signal generated by the PFC sensor between the PFC sensor and a processor used to convert the signal to the telemetry signal.

12. The method of claim 9, further comprising coupling multiple PFC sensors to the carrier and generating multiple signals indicative of the stress in the carrier from the PFC sensors.

13. The method of claim 9, wherein the stress is at least one of (a) a hoop stress, (b) an axial stress, or (c) a radial stress.

14. The method of claim 9, further comprising determining a transfer function for the telemetry signal.

15. The method of claim 9, further comprising modeling a voltage generated by the PFC sensor based on the stress.

16. The method of claim 9, wherein coupling the PFC sensor to the carrier comprises arranging the PFC sensor around at least a portion of the carrier.

17. The method of claim 16, wherein arranging the PFC sensor around the carrier includes arranging the PFC sensor to form at least one of (a) an arc around the carrier, (b) a ring around the carrier, or (c) a helix around the carrier.

18. A communications system, comprising:

a transmitter configured to receive data and transmit the data in a telemetry signal;

a carrier in communication with the transmitter, the transmitter configured to transmit the telemetry signal through a fluid within the carrier;

a piezoelectric fiber composite (PFC) sensor coupled to the carrier and configured to detect stress in the carrier indicative of the telemetry signal and generate a signal indicative of the detected stress in the carrier; and a processor configured to: receive the signal from the PFC sensor; and convert the signal generated by the PFC sensor into the telemetry signal.

19. The communications system of claim 18, wherein the PFC sensor comprises a sheet of piezoelectric fibers.

* * * * *